US005908348A

United States Patent [19]

Gottschald

[11] Patent Number: 5,908,348

[45] Date of Patent: Jun. 1, 1999

[54] METHOD FOR CNC-CONTROLLED SHAPE GRINDING OF SPECTACLE LENSES

[75] Inventor: Lutz Gottschald, Meerbusch, Germany

[73] Assignee: Wernicke & Co. GmbH, Düsseldorf, Germany

[21] Appl. No.: 08/962,069

[22] Filed: Oct. 31, 1997

[30] Foreign Application Priority Data

Jan. 23, 1997 [DE] Germany ..... 197 02 287

[51] Int. Cl.[6] ..... B24B 9/14

[52] U.S. Cl. ..... 451/5; 451/11; 451/43

[58] Field of Search ..... 451/5, 10, 11, 451/43

[56] References Cited

U.S. PATENT DOCUMENTS

| | | | |
|---|---|---|---|
| 4,737,918 | 4/1988 | Langlois et al. | 364/474 |
| 5,053,971 | 10/1991 | Wood et al. | 364/474.06 |
| 5,512,004 | 4/1996 | Strope | 451/5 |
| 5,538,459 | 7/1996 | Gottschald et al. | 451/11 |
| 5,588,899 | 12/1996 | Gottschald et al. | 451/5 |

FOREIGN PATENT DOCUMENTS

| | | |
|---|---|---|
| 3410040 | 9/1984 | Germany . |
| 8608201 | 9/1986 | Germany . |
| 3842601 | 7/1990 | Germany . |
| 4126313 | 3/1992 | Germany . |
| 9532075 | 11/1995 | WIPO . |

*Primary Examiner*—Timothy V. Eley
*Assistant Examiner*—Daniel G. Shanley
*Attorney, Agent, or Firm*—Robert W. Becker & Associates

[57] ABSTRACT

A method for machining a spectacle lens includes the step of inputting shape data of a spectacle frame opening or shape data of a shaped disk into a computing unit of a CNC-controlled spectacle lens grinding machine. Personal optometric data of a patient are input in the computing unit. A first radius of a front face of the lens blank and a second radius of a rear face of the lens blank as well as the thickness of the lens blank are input the Alternatively, the first and second radii and the thickness of the lens blank are calculated from the optometric data. The front edge curve and rear edge curve of the spectacle lens are either calculated from the shape data of the spectacle frame opening and the optometric data or based on the shape data of a shaped disk, the first and second radii and the thickness of the lens blank. The spacial curve of a suitable V-shaped bevel on the peripheral lens edge between the front edge curve and the rear edge curve is calculated. Grinding of the optical surfaces, of the peripheral lens edges, and of the V-shaped bevel by the spectacle lens grinding machine is controlled based on the shape data and the calculated spacial curve, respectively.

16 Claims, 2 Drawing Sheets

METHOD FOR CNC-CONTROLLED SHAPE GRINDING OF SPECTACLE LENSES

BACKGROUND OF THE INVENTION

The present invention relates to a method and a device for determining the course of the bevel at a edge of the spectacle lens to be machined by shape grinding and for controlling shape grinding according to the determined bevel course.

The bevel course along the edge of the spectacle lens to be ground should be determined such that the spectacle lens to be machined can be inserted without further machining steps into a correspondingly selected spectacle frame and, for aesthetic reasons, has along the circumferential edge of the ground spectacle lens the same distance from the front edge, even when the spectacle lens has a shape that deviates greatly from a circular shape, in order to prevent forward projection of the spectacle lens from the spectacle frame by different amounts.

For CNC-controlled grinding, especially grinding of the optical surfaces and the subsequent shape grinding of the circumferential edge and of the bevel of a spectacle lens, the shape of the spectacle lens and the personal optometric data of the patient are known which are supplied in the form of a set of data and with which the spectacle lens grinding machine can be controlled such that the lens blank is machined according to the personal optometric data of the patient relative to optical surfaces as well as relative to the shape of the selected spectacle frame. Also, the bevel (V-shaped bevel) is placed onto the circumferential edge of the ground spectacle lens such that it extends over the entire circumference of the circumferential edge and has, for example, a certain distance to the front edge of the shape-ground spectacle lens.

The data in regard to the shape of the spectacle frame can be present in the form of a data set supplied by the spectacle frame manufacturer or can be determined by inserting the spectacle frame into a device for sensing the bevel groove and by recording the data set in a three-dimensional array. It must be noted in this context that the bevel groove within the spectacle frame is not always positioned on a spherical surface due to manufacturing tolerances or shape deviations.

A device for three-dimensional sensing of spectacle frames is disclosed in German Gebrauchsmuster 86 08 201 U1 of the applicant.

In the published German patent application DE 34 10 040 A1, a CNC-controlled spectacle lens grinding machine is disclosed in which the outer surface and the inner surface of a circular lens blank, clamped into a spectacle lens grinding machine and already finish-machined with regard to optical surfaces, is traced along a curve corresponding to the desired shape of the spectacle lens by two elastically supported, pin-shaped sensors which rest directly on the lens blank. Their axial position is determined by potentiometers whereby the data and values detected by these potentiometers are supplied to a computer for calculating therefrom the spacial curve of the front edge and of the rear edge of the spectacle lens as well as the respective thickness of the spectacle lens. The computer selects from a number of memorized data sets of different V-shaped bevels that particular V-shaped bevel that can be applied to the circumferential edge of the shape-ground spectacle lens without leaving the circumferential edge at any location. The disclosed measuring device is integrated into the CNC-controlled spectacle lens grinding machine, and sensing of the lens blank is always carried out as the first step of the machining process performed by the CNC-controlled spectacle lens grinding machine. During sensing, shape-grinding of the lens blank is not possible.

When measuring a spectacle lens according to German patent DE 38 42 601 C2 of the applicant, whereby the front and rear edges of a pre-ground spectacle lens are measured during the machining process by a sensor head, there is no additional time expenditure during measuring of the spectacle lens. However, deviations of the spectacle lens from the spherical shape are incorporated into the measured values. Such deviations may result from a prismatic or cylindrical grinding superimposed onto the spherical grinding as well as from the arrangement of a reading portion within the spectacle lens. The off-center placement of the optical axis of the spectacle lens with regard to the geometric axis of the spectacle lens, respectively, the geometric center point of the spectacle frame, also plays a part.

The invention is therefore concerned with providing a method for detecting the bevel course along the edge of the spectacle lens to be machined and for controlling the shape grinding step according to the determined bevel course, whereby the degree of utilization of a CNC-controlled spectacle lens grinding machine should be improved and the precision of the bevel course should be increased, while operation should be simplified.

SUMMARY OF THE INVENTION

A method for machining a spectacle lens according to the present invention is primarily characterized by:

- Inputting shape data of a spectacle frame opening or shape data of a shaped disk having a contour matching the spectacle frame opening into a computing unit of a CNC-controlled spectacle lens grinding machine;
- Inputting personal optometric data of a patient into the computing unit;
- Inputting a first radius of a front face of the lens blank and a second radius of a rear face of the lens blank as well as a thickness of the lens blank or calculating the first and second radii of the lens blank and the thickness of the lens blank from the optometric data;
- Calculating a front edge curve and a rear edge curve of a spectacle lens to be ground from the lens blank based on the shape data of a spectacle frame opening and the optometric data or based on the shape data of a shaped disk, the first and second radii of the lens blank, and the thickness of the lens blank;
- Calculating a spacial curve of a suitable V-shaped bevel on the peripheral lens edge between the front edge curve and the rear edge curve;
- Controlling grinding of the optical surfaces and of the peripheral lens edge, based on the shape data by the spectacle lens grinding machine;
- Controlling grinding of the V-shaped bevel based on the calculated spacial curve.

Advantageously, the method includes the step of measuring the first radius of the front face, the second radius of the rear face, or the thickness of the lens blank by a laser beam measuring device.

Preferably, the method includes the step of measuring the first radius of the front face, the second radius of the rear face, or the thickness of the lens blank by a mechanical or opto-mechanical measuring system at the apex of the lens blank.

Advantageously, the method includes the step of measuring the first radius of the front face, the second radius of the rear face, or the thickness of the lens blank by an automated device for receiving lens blanks and inserting them into the spectacle lens grinding machine.

The present invention also relates to a method for machining a spectacle lens characterized by the steps of:

Inputting shape data of a spectacle frame opening or of a shaped disk into a computing unit of a CNC-controlled spectacle lens grinding machine;

Inputting personal optometric data of a patient;

Measuring a thickness of a lens blank, a front spacial curve, and a rear spacial curve of a spectacle lens to be machined based on the shape data of the spectacle frame opening or of the shaped disk by a measuring device that is separate from the spectacle lens grinding machine;

Inputting the measured data into the computing unit;

Optionally calculating a front edge curve of a spectacle lens to be ground from the lens blank and a rear edge curve of the spectacle lens based on the shape data of a spectacle frame opening and the optometric data or based on the shape data of a shaped disk and the first and second radii of the lens blank as well as the thickness of the lens blank;

Calculating a spacial curve of a suitable V-shaped bevel on the peripheral lens edge between the measured front edge curve and the measured rear edge curve or the calculated rear edge curve and the calculated front edge curve;

Controlling grinding of the optical surfaces and the peripheral lens edge, based on the shape data, by the spectacle lens grinding machine;

Controlling grinding of the V-shaped bevel based on the calculated spacial curve.

Preferably, the measuring device is a laser beam measuring device or the measuring device for measuring the thickness of the lens blank is a mechanical or opto-mechanical device.

For measuring the thickness of the lens blank, it is also possible to employ an automated device for receiving lens blanks and inserting them into the spectacle lens grinding machine.

The present invention also relates to a further method for machining a spectacle lens characterized by the following steps:

Inputting shape data of a spectacle frame opening or of a shaped disk into a computing unit of a CNC-controlled spectacle lens grinding machine;

Inputting personal optometric data of a patient;

Measuring a first radius of a front face of the lens blank and/or a second radius of a rear face of the lens blank as well as a thickness of the lens blank in a measuring device that is separate from the spectacle lens grinding machine;

Inputting the measured data into the computing unit;

Optionally calculating a front edge curve of a spectacle lens to be ground from the lens blank and a rear edge curve of the spectacle lens based on the shape data of a spectacle frame opening and the optometric data or based on the shape data of a shaped disk and the first and second radii of the lens blank as well as the thickness of the lens blank;

Calculating a spacial curve of a suitable V-shaped bevel on the peripheral lens edge between the measured front edge curve and the measured rear edge curve or the calculated rear edge curve and the calculated front edge curve;

Controlling grinding of the optical surfaces and the peripheral lens edge, based on the shape date, by the spectacle lens grinding machine;

Controlling grinding of the V-shaped bevel based on the calculated spacial curve.

Preferably, the measuring device is a laser beam measuring device or a mechanical or opto-mechanical device.

The measuring device may also be an automated device for receiving lens blanks and inserting them into the spectacle lens grinding machine.

The present invention relates to a further method for machining a spectacle lens characterized by the following steps:

Inputting shape data of a spectacle frame opening or of a shaped disk into a computing unit of a CNC-controlled spectacle lens grinding machine;

Inputting personal optometric data of a patent;

Measuring a thickness of the lens blank in a measuring device that is separate from the spectacle lens grinding machine or with a measuring device cooperating with the lens blank securing shaft of the spectacle lens grinding machine;

Inputting the measured data into the computing unit;

Optionally calculating a front edge curve of a spectacle lens to be ground from the lens blank and a rear edge curve of the spectacle lens based on the shape data of a spectacle frame opening and the optometric data or based on the shape data of a shaped disk and the first and second radii of the lens blank as well as the thickness of the lens blank;

Calculating a spacial curve of a suitable V-shaped bevel on the peripheral lens edge between the measured front edge curve and the measured rear edge curve or the calculated rear edge curve and the calculated front edge curve;

Controlling grinding of the optical surfaces and the peripheral lens edge, based on the shape data, by the spectacle lens grinding machine;

Controlling grinding of the V-shaped bevel based on the calculated spacial curve.

Advantageously, the measuring device is a laser beam measuring device or a mechanical or optomechanical device.

The measuring device may also be an automated device for receiving lens blanks and inserting them into the spectacle lens grinding machine.

The present invention also relates to a spectacle lens grinding machine comprising a lens blank securing shaft comprising a moveable securing part for clamping the lens blank at the securing shaft. The spectacle lens grinding machine further comprises a measuring device for detecting the travel stroke of the moveable securing part in order to detect the thickness of the lens blank secured at the securing shaft.

According to the present invention, a method is suggested that inventively is comprised of the following steps:

Inputting the shape data r (y, z) of a spectacle frame opening or the shape data r (y) of a shaped disk into the computing unit of a CNC-controlled spectacle lens grinding machine;

Inputting the personal optometric data of the patient into the computing unit;

Inputting the radius R1 of the front face and the R2 of the rear face as well as the thickness d of the lens blank or calculating the radii R1, R2 and the thickness d of the lens blank from the optometric data;

Calculating the front and rear edge curves of the spectacle lens from the shape data and the personal optometric data or from the shape data and the radii R1 and R2 and from the thickness d;

Calculating the spacial course of a suitable V-shaped bevel at the peripheral lens edge between the front or rear edge curves calculated based on the input data;

Controlling the machining (grinding) of the optical surfaces and/or of the peripheral edge by the spectacle lens grinding machine according to the shape data;

Controlling the grinding of the bevel according to the calculated spacial course of a suitable V-shaped bevel or Inputting the shape data r (y, z) of a spectacle frame opening or the shape data r (y) of a shaped disk into a computing unit of a CNC-controlled spectacle lens grinding machine;

Inputting the personal optometric data of the patient into the computing unit;

Measuring the thickness d of a lens blank as well as the front and rear spacial curves of the spectacle lens according to the shape data of the spectacle lens opening or the shaped disk in a measuring device that is separate from the spectacle lens grinding machine or Measuring the radius R1 of the front face and/or the radius R2 of the rear face and the thickness d of the lens blank in a measuring device separate from the spectacle lens grinding machine or Measuring the thickness d of the lens blank in a measuring device separate from the spectacle lens grinding machine or by a measuring device cooperating with a spectacle lens securing shaft within the spectacle lens grinding machine;

Transferring the measured values into the computing unit;

Optionally calculating the front and rear edge curves of the spectacle lens from the shape data and the personal optometric data or from the shape data and the radii R1 and R2 as well as the thickness d;

Calculating the spacial course of a suitable V-shaped bevel on the peripheral lens edge between the front or rear edge curves measured or correspondingly calculated based on the input values;

Controlling machining (grinding) of the optical surfaces and/or of the edges by the spectacle lens grinding machine according to the shape data;

Controlling the shaping of the bevel according to the calculated spacial course of the suitable V-shaped bevel.

The invention is based on the concept that for the spectacle lens grinding machine idle times must be avoided and that it should therefore only perform machining steps in order to achieve the highest possible degree of utilization, while all machining steps required for preparation should be performed external of the grinding machine but in close proximity.

Accordingly, all measurements to be performed that require a special or additional step are to be performed outside of the spectacle lens grinding machine. Only functions which can be combined with already needed machining steps are to be performed within the spectacle lens grinding machine without thereby increasing idle times. This includes measuring of the thickness d of the lens blank which can be performed within the grinding machine when the lens blank is clamped into the lens blank securing shaft because the movement of the lens blank securing shaft for clamping can be used for measuring the thickness d of the lens blank.

Furthermore, the computing capability or performance of the computing unit, present for controlling the grinding machine, can be used in order to perform all calculations based on the input or measured data, whereby such calculations can be programmed and can be performed at great computing speed. An additional main frame computer or central computer is not required because a respectively programmed computing unit, which can be integrated into the spectacle lens grinding machine and can be used for the CNC-control, is completely sufficient.

For example, the computing unit can calculate the spacial course of a suitable V-shaped bevel along the peripheral lens edge between the front and rear edge curve of the spectacle lens by inputting, on the one hand, the personal optometric data of the patient, such as dioptry, the axis position of the cylindrical or prismatic grinding, the position of a reading portion of the spectacle lens, and the decentralized values of the predetermined contour with respect to the optical axis of the lens blank, and, on the other hand, the thickness d of the lens blank as well as the front and rear edge curves of the spectacle lens, determined according to the shape data of the spectacle lens frame opening or the shaped disk. The latter data are also input in the form of data sets into the computing unit and which have been determined by a measuring device separate from the spectacle lens grinding machine and transmitted to the computing unit, so that the computing unit can calculate therefrom the spacial course of a suitable V-shaped bevel. It is also possible that only the radius R1 of the front face and/or the radius R2 of the rear face as well as the thickness d of the lens blank are measured within a measuring device that is separate from the spectacle lens grinding machine. These data are then used together with the other data for calculating the spacial course of a suitable V-shaped bevel.

Also, it may be sufficient to input all data into the computing unit so that the computing unit, by using a suitable algorithm, can first determine the front and rear optical surfaces and can then calculate the front and rear edge curves of the spectacle lens from the shape data and the personal optometric data or from the shape data and the radii R1 and R2 as well as the input or measured thickness d. The spacial course of a suitable V-shaped bevel on the peripheral edge between the front and rear edge curves is then determined therefrom, whereafter these values are used for controlling the machining of the optical surfaces and/or the peripheral lens edge by the shape grinding machine according to the shape data and for controlling the shape machining of the bevel corresponding to the calculated spacial course of the suitable V-shaped bevel. It may be sufficient to measure only one of the radii R1 or R2 and the thickness d because the second radius of the spectacle lens, is in general, known and can be directly input into the computer.

Advantageously, the radii R1, R2 and their thickness d or the front and rear spacial curves can be measured by a mechanical or opto-mechanical measuring system that is either contained within the spectacle lens grinding machine or is a separate measuring device or an automatic device for receiving lens blanks and inserting them into the spectacle lens grinding machine.

The spectacle lens grinding machine with a spectacle lens securing shaft, into which the spectacle lens blank to be machined is clamped, can advantageously be used for measuring the thickness d of the clamped lens blank by using the travel stroke of an axially displaceable part of the spectacle lens securing shaft so that the thickness of the lens blank is automatically measured during clamping within the spectacle lens securing shaft and can be transmitted to the computing unit.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
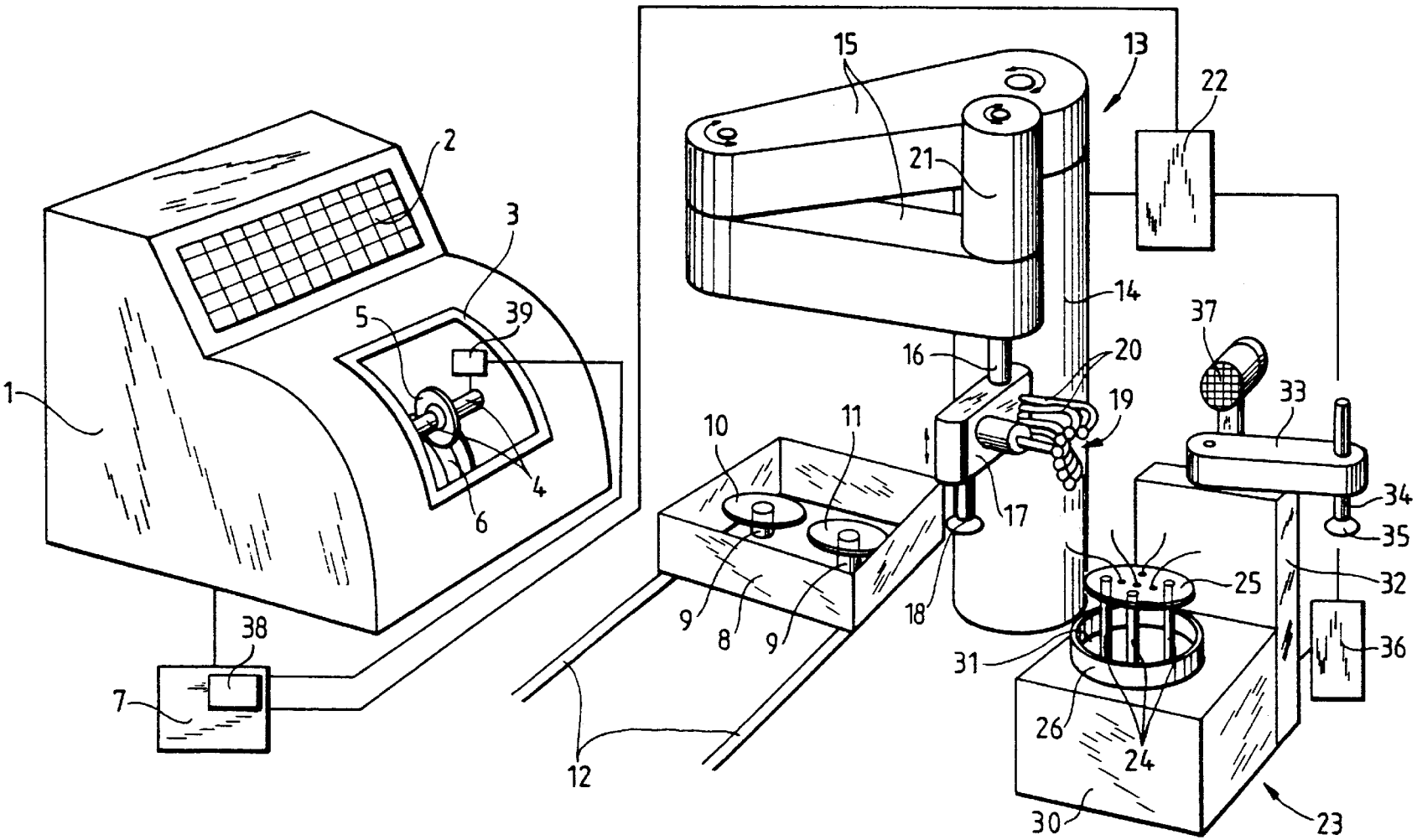
FIG. 1 is a schematic perspective view of a device for CNC-controlled grinding of spectacle lenses.

The present invention will now be described in detail with the aid of several specific embodiments utilizing FIGS. 1 and 2.

The inventive device for machining the peripheral edge of spectacle lenses comprises a CNC-controlled spectacle lens grinding machine 1 with input keyboard 2, a flap 3 with a window, and a spectacle lens securing shaft 4 positioned behind the flap 3. A lens blank 5 is secured at the shaft 4 for undergoing a CNC-controlled shape grinding by the grinding wheel 6. A computing unit 7, which is represented as a table top computer external to the lens blank grinding machine 1 but can also be integrated into it, effects the shape grinding of the lens blank 5 according to the input data for the shape of the spectacle lens.

The keyboard 2 can, of course, be also external to the lens blank grinding machine 1, especially in connection with the computing unit 7, which may comprise a monitor 38 in order to display the input data etc.

A box 8 with two supports 9 for horizontally arranged lens blanks, i.e., a left lens blank 10 and a right lens blank 11, can be moved by a non-represented transporting device on the guide rails 12 into the vicinity of the handling device 13. This handling device 13 is secured by a stationary holder 14 and comprises a pair of arms 15 at the upper end of the holder 14. The arms 15 are moveable about vertical axis. At the free end of one of the pivotable arms 15, a rotatable and displaceable guide rod 16 is arranged within a head 21 that is provided with a drive unit. At the lower end of the guide rod 16, a further head 17 is provided. The head 17 is a support for a stationary suction cup 18 that extends perpendicularly relative to the head 17 and for six further suction cups 19 that can be rotated about a horizontal axis and are arranged in a semi-circular array on a ring segment. Each one of the suction cups 19 has a suction line 20 connected thereto. The lines 20 extent into the head 17 and from there via non-represented sensors to a vacuum container or a vacuum pump. A respective suction line is also provided for the suction cup 18.

The head 17 can be moved into the vicinity of the spectacle lens grinding machine 1, the box 8, and an opto-electronic detection system 23 for spectacle lenses by a control device 22 that is connected to the computing unit 7 and can also be part of the computing unit 7. The opto-electronic detecting system 23 comprises a housing 30 with an upwardly oriented opening 31. The opening 31 is surrounded by a shield 26 from which three pins 24 project to provide a three-point support for a lens blank 25.

An upwardly extending support 32 is provided at one side of the housing 30 and supports a pivot arm 33. This pivot arm 33 has at its free end an axially displaceable guide rod 34 with a soft-elastic head 35 at its free end. This soft-elastic head 35 can be pivoted by pivoting the pivot arm 33 into a position above the lens blank 25. By lowering the guide rod 34 the soft-elastic head 35 will come into contact with the lens blank 25 and secures it on the three-point support 24. At the support 32 a lighting device 37 is fastened that provides for a slanted illumination of the lens blank 25.

A non-represented CCD camera is arranged within the housing 30 below the opening 31 and comprises a control unit 36 with an electronic image processing and evaluation system. The camera is also connected to the control unit 22 of the handling device 13. The control unit 36 can also be incorporated into the computing unit 7.

In the working range of the handling device 13, a laser beam measuring device is arranged which has a base plate 41 on which a turntable 42 is arranged. This turntable 42 is provided with a suction cup for securing a lens blank 51 at one side. Protective walls 43 are arranged about the base plate 41 which close off the working space above the base plate 41. A holder 44, fastened laterally at the base plate 41, has a securing head 50 for supporting an axially displaceable telescopic arm 46. At the free arm of the telescopic arm 46 a guide 47 is arranged which supports a spindle 48 that can be reciprocated. At the lower end of the spindle 48 a laser beam source 49 is provided which emits the measuring beam 100.

In order to measure the radius R1 or R2 of the surface of the lens blank 51 facing the laser beam source 49, it is sufficient to move the laser beam source 49 by axial displacement of the telescopic arm 46 across the lens blank 51 and to record the height differences measured across the surface. The computing unit 7 calculates based thereon the radius R1 or R2, depending on which side of the lens blank 51 faces the laser be am source 49 When both radii R1 and R2 are measured in this manner by turning over the lens blank, the respective thickness d of the lens blank within the optical center point can also be measured.

Figure 2:
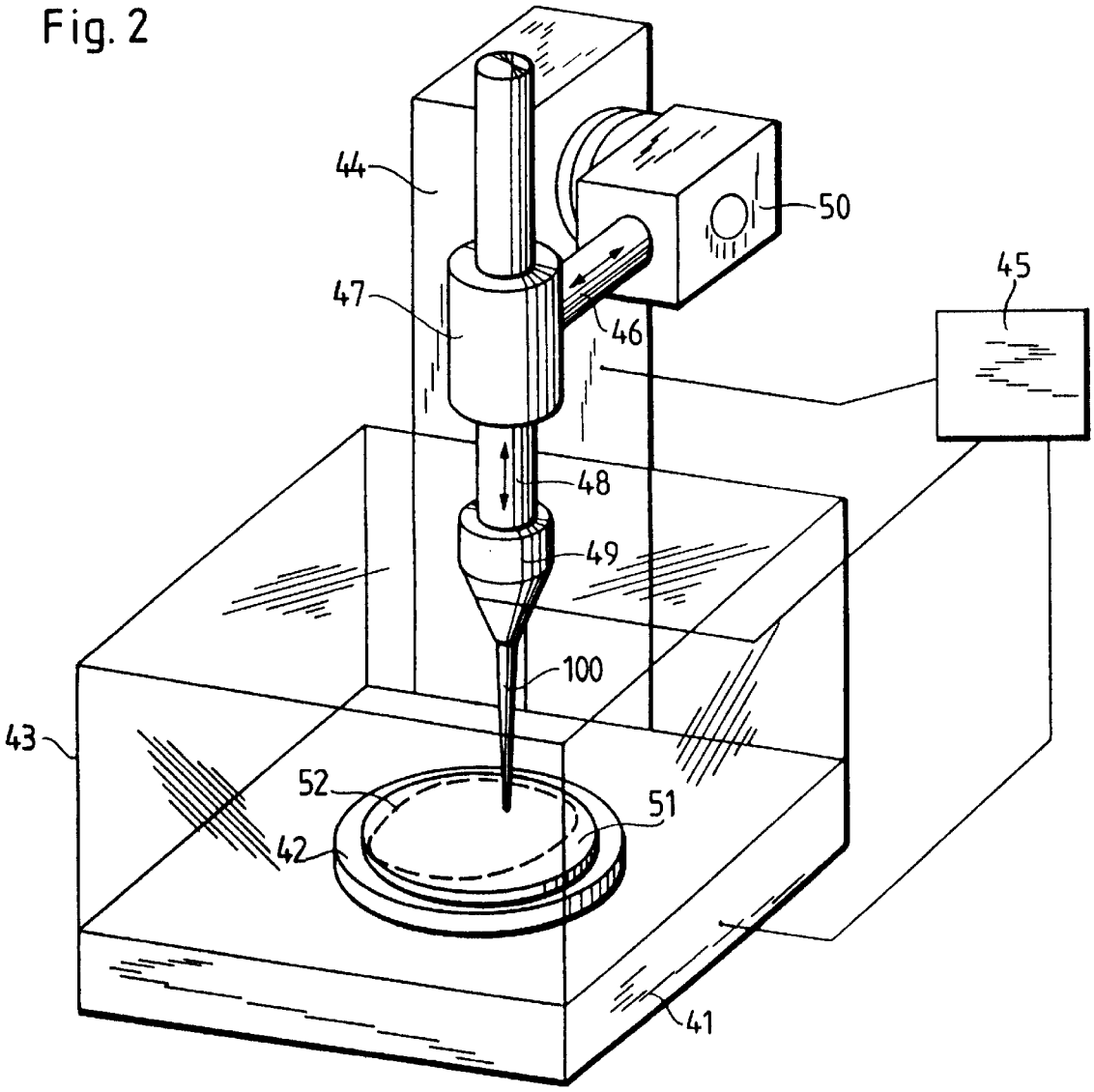
FIG. 2 is a schematic perspective representation of a measuring device for measuring the radius R1 of the front face and/or the radius R2 of the rear face and the thickness d of the lens blank as well as optionally of the front and rear edge curves of the spectacle lens according to the shape data of the spectacle frame opening or the shaped disk.

With the measuring device represented in FIG. 2 the front and rear spacial curves of the spectacle lens according to the shape of the spectacle lens opening or the shaped disk can be measured when the movement of the telescopic arm 46, controlled by the computing unit 7 via the control device 45, and the simultaneous rotation of the turntable 43 are controlled such that the measuring beam 100 senses the entire surface of the lens blank 51 according to the shape 52 of the spectacle lens.

Instead of the represented laser measuring device, it is also possible to use a mechanical or opto-mechanical measuring system that performs the measurement within the apex of the lens blank.

The lens blank 51 is inserted into the measuring device and also removed therefrom by the handling device 13 and can subsequently be inserted into the opto-electronic detecting system 23 or can directly be inserted into the spectacle lens securing shaft 4 of the spectacle lens grinding machine 1.

The computing unit 7 calculates, based on the measured data and the input data, which relate to the personal optometric data of the patient, the shape of the spectacle frame opening, or the shape disk, the spacial course of a suitable V-shaped bevel at the peripheral lens edge of the spectacle lens between the front and rear edge curves and controls the machining of the lens blank 5 according to these calculated values. First, the lens blank 5 is machined according to the shape determined by the shape data of the spectacle frame opening or the shaped disk. Subsequently, the V-shaped bevel is applied to the peripheral lens edge between the front and the rear edge curves so that it matches the requirements with regard to an aesthetically pleasing arrangement of the spectacle lens within the selected spectacle frame and allows the insertion of the shaped spectacle lens into the selected spectacle frame without difficulties.

Since the spectacle lens grinding machine 1 performs only machining processes, but no measuring processes which would cause additional idle times, the degree of utilization of the machine can be improved. The operation of the spectacle lens grinding machine 1 is very simple because the available personal optometric data of the patient can be entered by the alphanumeric keyboard 2 while the further machining steps are automatically controlled by the computing unit 7.

All entered and measured data can be controlled by a representation on the monitor 38 so that an error-free operation or error-free machining is ensured.

The detecting system 23, based on opto-electronic concepts with an electronic image processing and evaluation system 36, also facilitates manipulation and improves precision achieved by the spectacle lens grinding machine 1 because the image processing and evaluation system 36 provides such precise data for the control of the handling device 13 that lens blanks can be machined within the DNC-controlled spectacle lens grinding machine 1 very precisely and without requiring further machining steps before placement into the spectacle frame according to whose data the spectacle lens has been ground. The decentralization values of the optical center point of the patient, determined by the optometrist with respect to the geometric center point of the spectacle frame opening, can either be taken into consideration by the CNC control of the spectacle frame grinding machine 1, or the handling device 13 can position a lens blank into the spectacle lens grinding machine 1 not only angle-precisely with respect to the position of the axis of a cylindrical or prismatic grinding, respectively, the position of the reading portion of the spectacle lens, but also displaced by the decentralization value so that a recalculation of the data of the spectacle lens shape with consideration of the decentralization value is not required.

Adjacent to the represented CNC-controlled spectacle lens grinding machine 1, a machine for CNC-controlled machining of the optical surfaces may be positioned which can be controlled by the computing unit 7 with the aid of the same data sets for the purpose of machining the optical surfaces. The handling device 13 can then serve to automatically move the lens blank between the spectacle lens grinding machine and the non-represented surface grinding machine.

When the grinding steps of the optical surfaces and of the peripheral edge, including the bevel, are combined in one machine, such a transport step by the handling device is no longer required.

The present invention is, of course, in no way restricted to the specific disclosure of the specification and drawings, but also encompasses any modifications within the scope of the appended claims.

What I claim is:

1. A method for machining a spectacle lens, said method comprising the steps of:

inputting shape data of a spectacle frame opening or shape data of a shaped disk, having a contour matching the spectacle frame opening, into a computing unit of a CNC-controlled spectacle lens grinding machine;

inputting personal optometric data of a patient into the computing unit;

inputting a first radius of a front face of a lens blank and a second radius of a rear face of said lens blank as well as a thickness of said lens blank or calculating said first radius of the front face and said second radius of the rear face and the thickness of said lens blank from the optometric data;

calculating a front edge curve and a rear edge curve of a spectacle lens to be ground from said lens blank based on said shape data of the spectacle frame opening and the optometric data or based on said shape data of the shaped disk, said first radius of the front face, said second radius of the rear face, and the thickness of said lens blank;

calculating a spacial curve of a suitable V-shaped bevel on the peripheral lens edge between the front edge curve and the rear edge curve;

controlling grinding of the optical surfaces of said spectacle lens and of the peripheral lens edge, based on said shape data of the spectacle frame opening or said shape data of the shaped disk, by the spectacle lens grinding machine;

controlling grinding to produce said suitable V-shaped bevel based on said spacial curve.

2. A method according to claim 1, including the step of measuring said first radius of the front face, said second radius of the rear face, or the thickness of said lens blank by a laser beam measuring device.

3. A method according to claim 1, including the step of measuring said first radius of the front face, said second radius of the rear face, or the thickness of said lens blank by a mechanical or opto-mechanical measuring system at the apex of the lens blank.

4. A method according to claim 1, including the step of measuring said first radius of the front face, said second radius of the rear face, or the thickness of said lens blank by an automated device for receiving lens blanks and inserting them into the spectacle lens grinding machine.

5. A method for machining a spectacle lens, said method comprising the steps of:

inputting shape data of a spectacle frame opening or of shape data of a shaped disk, having a contour matching the spectacle frame opening, into a computing unit of a CNC-controlled spectacle lens grinding machine;

inputting personal optometric data of a patient;

measuring a thickness of a lens blank, a front spacial curve, and a rear spacial curve of a spectacle lens to be machined based on said shape data of the spectacle frame opening or of said shape data of the shaped disk by a measuring device that is separate from the spectacle lens grinding machine;

inputting the measured data into the computing unit;

optionally calculating a front edge curve of a spectacle lens to be ground from said lens blank and a rear edge curve of said spectacle lens based on said shape data of the spectacle frame opening and the optometric data or based on said shape data of the shaped disk, first and second radii of said lens blank as well as the thickness of said lens blank;

calculating a spacial curve of a suitable V-shaped bevel on the peripheral lens edge between the measured front edge curve and the measured rear edge curve or the calculated rear edge curve and the calculated front edge curve;

controlling grinding of the optical surfaces of said spectacle lens and the peripheral lens edge, based on said shape data of the spectacle frame opening or said shape data of the shaped disk, by the spectacle lens grinding machine;

controlling grinding to produce said suitable V-shaped bevel based on said spacial curve.

6. A method according to claim 5, wherein, in the step of measuring, the measuring device is a laser beam measuring device.

7. A method according to claim 5, wherein, in the step of measuring, the measuring device for measuring the thickness of the lens blank is a mechanical or opto-mechanical device.

8. A method according to claim 5, wherein, in the step of measuring, the measuring device for measuring the thickness of the lens blank is an automated device for receiving lens blanks and inserting them into the spectacle lens grinding machine.

9. A method for machining a spectacle lens, said method comprising the steps of:

inputting shape data of a spectacle frame opening or of shape data of a shaped disk, having a contour matching the spectacle frame opening, into a computing unit of a CNC-controlled spectacle lens grinding machine;

inputting personal optometric data of a patient;

measuring at least one of a first radius of a front face of a lens blank and a second radius of a rear face of said lens blank in addition to a thickness of said lens blank in a measuring device that is separate from the spectacle lens grinding machine;

inputting the measured data into the computing unit;

optionally calculating a front edge curve of a spectacle lens to be ground from said lens blank and a rear edge curve of said spectacle lens based on said shape data of the spectacle frame opening and the optometric data or based on said shape data of the shaped disk and said at least one of said first radius of the front face and said second radius of the front face in addition to the thickness of said lens blank;

calculating a spacial curve of a suitable V-shaped bevel on the peripheral lens edge between the measured front edge curve and the measured rear edge curve or the calculated rear edge curve and the calculated front edge curve;

controlling grinding of the optical surfaces of said spectacle lens and the peripheral lens edge, based on said shape data of the spectacle frame opening or said shape data of the shaped disk, by the spectacle lens grinding machine;

controlling grinding to produce said suitable V-shaped bevel based on said spacial curve.

10. A method according to claim 9, wherein, in the step of measuring, the measuring device is a laser beam measuring device.

11. A method according to claim 9, wherein, in the step of measuring, the measuring device is a mechanical or opto-mechanical device.

12. A method according to claim 9, wherein, in the step of measuring, the measuring device is an automated device for receiving lens blanks and inserting them into the spectacle lens grinding machine.

13. A method for machining a spectacle lens, said method comprising the steps of:

inputting shape data of a spectacle frame opening or of shape data of a shaped disk, having a contour matching the spectacle frame opening, into a computing unit of a CNC-controlled spectacle lens grinding machine;

inputting personal optometric data of a patient;

measuring a thickness of a lens blank in a measuring device that is separate from the spectacle lens grinding machine or with a measuring device cooperating with a lens blank securing shaft of the spectacle lens grinding machine;

inputting the measured data into the computing unit;

optionally calculating a front edge curve of a spectacle lens to be ground from said lens blank and a rear edge curve of said spectacle lens based on said shape data of the spectacle frame opening and the optometric data or based on said shape data of the shaped disk, first and second radii of said lens blank and the thickness of said lens blank;

calculating a spacial curve of a suitable V-shaped bevel on the peripheral lens edge between the measured front edge curve and the measured rear edge curve or the calculated rear edge curve and the calculated front edge curve;

controlling grinding of the optical surfaces of said spectacle lens and the peripheral lens edge, based on said shape data of the spectacle frame opening or said shape data of the shaped disk, by the spectacle lens grinding machine;

controlling grinding to produce said suitable V-shaped bevel based on the said spacial curve.

14. A method according to claim 13, wherein, in the step of measuring, the measuring device is a laser beam measuring device.

15. A method according to claim 13, wherein, in the step of measuring, the measuring device is a mechanical or opto-mechanical device.

16. A method according to claim 13, wherein, in the step of measuring, the measuring device is an automated device for receiving lens blanks and inserting them into the spectacle lens grinding machine.

* * * * *